US009095752B2

(12) United States Patent
Stites et al.

(10) Patent No.: US 9,095,752 B2
(45) Date of Patent: Aug. 4, 2015

(54) GOLF CLUBS AND GOLF CLUB HEADS

(75) Inventors: John T. Stites, Weatherford, TX (US); Gary G. Tavares, Azle, TX (US)

(73) Assignee: NIKE, Inc., Beaverton, OR (US)

( * ) Notice: Subject to any disclaimer, the term of this patent is extended or adjusted under 35 U.S.C. 154(b) by 169 days.

(21) Appl. No.: 13/312,982

(22) Filed: Dec. 6, 2011

(65) Prior Publication Data

US 2012/0077616 A1 Mar. 29, 2012

Related U.S. Application Data

(63) Continuation of application No. 11/125,327, filed on May 10, 2005.

(51) Int. Cl.
*A63B 53/04* (2006.01)

(52) U.S. Cl.
CPC ..... *A63B 53/0466* (2013.01); *A63B 53/04* (2013.01); *A63B 2053/0408* (2013.01); *A63B 2053/0412* (2013.01); *A63B 2053/0433* (2013.01)

(58) Field of Classification Search
USPC ..... 473/324–350
See application file for complete search history.

(56) References Cited

U.S. PATENT DOCUMENTS

| | | | | |
|---|---|---|---|---|
| 1,334,189 A | | 3/1920 | Swanson | |
| D206,888 S | | 2/1967 | Blitz, Jr. | |
| D229,431 S | | 11/1973 | Baker | |
| 3,975,023 A | | 8/1976 | Inamori | |
| 3,981,507 A | | 9/1976 | Nunziato | |
| 4,010,958 A | | 3/1977 | Long | |
| 4,021,047 A | | 5/1977 | Mader | |
| D259,941 S | | 7/1981 | James | |
| D268,357 S | | 3/1983 | Mader | |
| 4,828,265 A | | 5/1989 | Antonious | |
| 4,890,840 A | * | 1/1990 | Kobayashi | 473/344 |
| 5,354,055 A | * | 10/1994 | MacKeil | 473/314 |
| 5,421,577 A | | 6/1995 | Kobayashi | |
| 5,431,401 A | | 7/1995 | Smith | |
| 5,464,211 A | | 11/1995 | Atkins, Sr. | |
| D372,063 S | | 7/1996 | Hueber | |

(Continued)

FOREIGN PATENT DOCUMENTS

| | | |
|---|---|---|
| JP | 3017932 U | 11/1995 |
| JP | 3030545 U | 11/1996 |

(Continued)

OTHER PUBLICATIONS

Ellis, Jeffery. The Clubmaker's Art: Antique Golf Clubs and Their History, Washington: Zephyr Production, Inc., 1997, p. 474 and 490.*

(Continued)

*Primary Examiner* — Alvin Hunter
(74) *Attorney, Agent, or Firm* — Banner & Witcoff, Ltd.

(57) ABSTRACT

Golf clubs and/or golf club heads include a club head body defining an interior chamber, structure for engaging a shaft with the body, and/or a shaft engaged with the body. The club head body may have an overall length of at least 4.5 inches and an overall breadth of at least 4.2 inches. In other examples, the club head body may have an overall length of at least 4.6 inches and a ratio of the overall breadth dimension to the overall length dimension of 1 or less. If desired, the ratio of the head breadth to head length dimensions may be in a range from at least 0.94 to 1 or less.

35 Claims, 4 Drawing Sheets

(56) References Cited

U.S. PATENT DOCUMENTS

| | | | | |
|---|---|---|---|---|
| D402,341 | S | 12/1998 | Hamm | |
| 5,888,148 | A | 3/1999 | Allen | |
| 5,935,020 | A | 8/1999 | Stites et al. | |
| 5,947,838 | A | 9/1999 | Tkacs | |
| D415,807 | S | 10/1999 | Werner et al. | |
| 6,012,989 | A | 1/2000 | Saksun, Sr. | |
| 6,152,833 | A | 11/2000 | Werner et al. | |
| 6,425,832 | B2 | 7/2002 | Cackett et al. | |
| 6,478,692 | B2 | 11/2002 | Kosmatka | |
| 6,491,592 | B2 | 12/2002 | Cackett et al. | |
| 6,582,323 | B2 | 6/2003 | Soracco | |
| 6,602,149 | B1 | 8/2003 | Jacobson | |
| 6,620,055 | B2 | 9/2003 | Saso | |
| 6,648,773 | B1 | 11/2003 | Evans | |
| D489,105 | S | 4/2004 | Kim | |
| 6,719,643 | B1 | 4/2004 | Helmstetter et al. | |
| 6,758,763 | B2 | 7/2004 | Murphy et al. | |
| 6,991,558 | B2 | 1/2006 | Beach et al. | |
| D524,890 | S | 7/2006 | Foster et al. | |
| 7,169,060 | B2 | 1/2007 | Stevens et al. | |
| 7,226,366 | B2 | 6/2007 | Galloway | |
| 7,252,600 | B2 | 8/2007 | Murphy et al. | |
| 7,448,960 | B2 | 11/2008 | Gibbs et al. | |
| 7,846,038 | B2 * | 12/2010 | Foster et al. | 473/329 |
| 2002/0006836 | A1 | 1/2002 | Helmstetter et al. | |
| 2002/0094884 | A1 | 7/2002 | Hocknell et al. | |
| 2002/0160854 | A1 | 10/2002 | Beach et al. | |
| 2003/0100381 | A1 * | 5/2003 | Murphy et al. | 473/342 |
| 2003/0232662 | A1 | 12/2003 | Hocknell et al. | |
| 2004/0142761 | A1 | 7/2004 | Evans | |
| 2004/0173964 | A1 | 9/2004 | Pollman | |
| 2004/0192467 | A1 | 9/2004 | Hocknell et al. | |
| 2004/0219991 | A1 | 11/2004 | Suprock et al. | |
| 2005/0037857 | A1 | 2/2005 | Best et al. | |
| 2005/0239576 | A1 | 10/2005 | Stites et al. | |
| 2006/0035722 | A1 | 2/2006 | Beach et al. | |
| 2006/0148586 | A1 | 7/2006 | Williams et al. | |
| 2006/0148587 | A1 | 7/2006 | Stevens et al. | |
| 2006/0148588 | A1 | 7/2006 | Gibbs et al. | |

FOREIGN PATENT DOCUMENTS

| | | | |
|---|---|---|---|
| JP | 09253242 | A | 9/1997 |
| JP | 2000210398 | A | 8/2000 |
| JP | 2002301174 | A | 10/2002 |
| JP | 2003062130 | A | 3/2003 |
| JP | 2003245381 | A | 9/2003 |
| JP | 200565996 | A | 3/2005 |
| JP | 2007549546 | A | 7/2008 |
| WO | 2006073930 | A2 | 7/2006 |

OTHER PUBLICATIONS

Jackson, Jeff, The Modern Guide to Golf Club Making. Ohio: Dynacraft Golf Products, Inc., copyright 1994, p. 63.
http://www.donogolf.com, dated Feb. 2, 2006.
http://www.mcx.co.jp/katayama/wood.html, dated Nov. 6, 2006.
http://www.mcx.co.jp/katayama/bdream.html, dated Nov. 6, 2006.
http://www.mcx.co.jp/katayama/sq.html, dated Nov. 6, 2006.
Notice of Allowance, Australian SN 2010202895, dated Jun. 26, 2012.
Notice of Acceptance, Australian SN 2010202897, dated Nov. 23, 2011.
Office Action, Australian SN 2010202895, dated May 20, 2011.
Office Action, Australian SN 2010202897, dated May 20, 2011.
Office Action, Australian SN 2005331540, dated Mar. 30, 2009.
Office Action, Canadian SN 2,605,542, dated Apr. 27, 2010.
Office Action, Canadian SN 2,605,542, dated Jun. 23, 2009.
Office Action, Chinese SN 201010240731.5, dated Sep. 4, 2013.
Office Action, Chinese SN 2005800497314, dated Dec. 11, 2009.
Office Action, Chinese SN 2005800497314, dated Mar. 6, 2009.
Office Action, EP SN 05795305.1, dated Feb. 5, 2010.
Office Action, EP SN 11155663.5, dated Feb. 23, 2012.
Search Report, EP SN 12155402.6, dated Apr. 23, 2012.
Office Action, Japanese SN 2010-174290, dated Jul. 25, 2013.
Office Action, Japanese SN 2010-174290, dated Mar. 15, 2012.
Office Action, Japanese SN 2008-511100, dated Oct. 6, 2010.
Office Action, Japanese SN 2008-511100, dated Feb. 4, 2010.
Office Action, Japanese SN 2010-174290, dated Sep. 19, 2012.
Office Action, Korean SN 10-2007-7025823, dated Aug. 14, 2009.
Office Action, Korean SN 10-2009-7026039, dated Mar. 15, 2010.
Office Action, Korean SN 10-2010-7017344, dated Jul. 28, 2011.
Office Action, Korean SN 10-2010-7017344, dated Nov. 1, 2010.
Nike Ignite + Driver, Golf News, dated Dec. 9, 2003.
Takebayashi, Takamitsu, Ignite Plus 460 Driver, dated Jul. 20, 2005, pp. 48, 104, 105, 226.
Notice of Allowance, Taiwan SN 95112154, dated Jun. 17, 2008.
IPER, PCT/US2005/032124, dated Nov. 22, 2007.
Extended Search Report, EP SN 11155663.5, dated May 17, 2011.
Office Action, Chinese SN 2010102407315, dated Jun. 24, 2011.
Office Action, Chinese SN 201010240731.5, dated Nov. 24, 2011.
Japanese Office Action issued Mar. 16, 2015 in Japanese Application No. 2013-242482.

* cited by examiner

GOLF CLUBS AND GOLF CLUB HEADS

RELATED APPLICATION DATA

This application is a continuation of U.S. patent application Ser. No. 11/125,327 filed May 10, 2005 in the names of John T. Stites and Gary G. Tavares and entitled "Golf Clubs and Golf Club Heads," which application is entirely incorporated herein by reference.

FIELD OF THE INVENTION

This invention relates generally to golf clubs and golf club heads, including "wood-type" golf clubs and golf club heads, e.g., for drivers, fairway woods, hybrid or utility clubs, or the like.

BACKGROUND

Golf is enjoyed by a wide variety of players—players of different genders and players of dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world. The number of individuals participating in the game and the number of golf courses have increased steadily in recent years.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing and/or teaching aids also are available on the market that promise to help lower one's golf scores.

Being the sole instrument that sets a golf ball in motion during play, the golf club also has been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Despite recent technological advances, "wood-type" golf clubs, particularly the driver, can be very difficult for some players to hit consistently well. Accordingly, additional technological advances that improve a player's ability to get a golf ball airborne, increase distance and/or control, and/or otherwise improve the playability of wood-type golf clubs, particularly the driver, would be welcome in the golf world.

SUMMARY

The following presents a general summary of aspects of the invention in order to provide a basic understanding of the invention and various aspects of it. In general, some example aspects of this invention relate to golf clubs and/or golf club heads that include a club head body defining an interior chamber, wherein the club head body has an overall club head length dimension of at least 4.5 inches and an overall club head breadth dimension of at least 4.2 inches. The club head further may include a hosel element, a shaft insertion opening, and/or other structure and/or means for receiving and/or engaging a shaft with the club head body; and/or a shaft engaged with the club head. In at least some example structures in accordance with the invention, the club head body may have an overall club head length dimension of at least 4.6 inches, a ratio of the overall club head breadth dimension to the overall club head length dimension of at least 0.94, and/or a ratio of the overall club head breadth dimension to the overall club head length dimension of 1 or less.

Golf clubs and/or golf club heads in accordance with still other example aspects of this invention may include a club head body defining an interior chamber, wherein the club head body has an overall club head length dimension of at least 4.6 inches and wherein the club head body has a ratio of an overall club head breadth dimension to the overall club head length dimension of 1 or less. The club head further may include a hosel member, a shaft insertion opening, and/or other means for receiving and/or engaging a shaft with the club head body; and/or a shaft engaged with the club head body. In such golf clubs and/or golf club heads, the club head body may have an overall club head breadth dimension of at least 4.3 inches, at least 4.4 inches, at least 4.5 inches, or even at least 4.6 inches.

BRIEF DESCRIPTION OF THE DRAWINGS

A more complete understanding of the present invention and certain advantages thereof may be acquired by referring to the following detailed description in consideration with the accompanying drawings, in which.

Figure 1A:
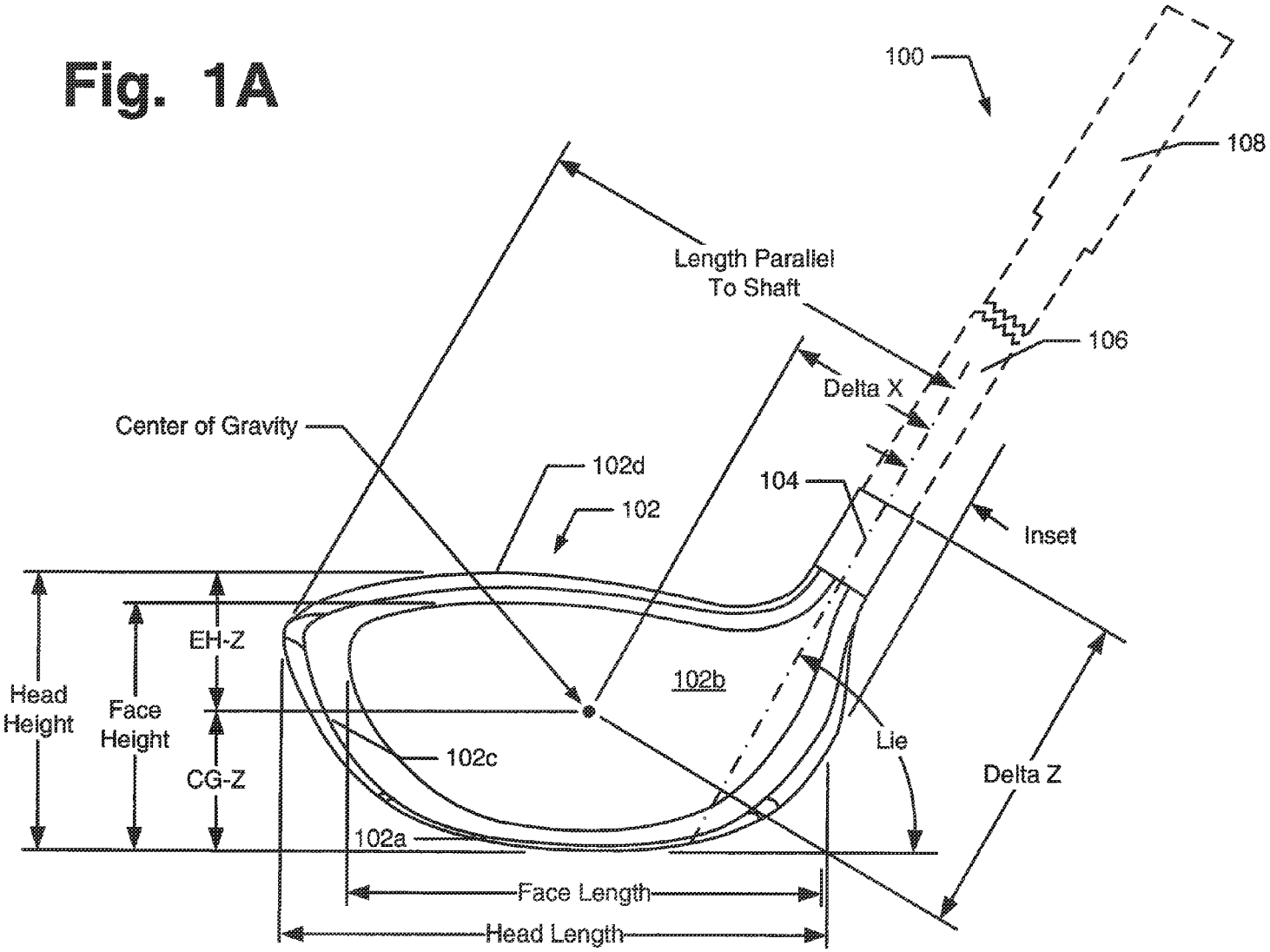
FIGS. 1A through 1C illustrate example golf club heads and golf club structures in accordance with this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Certain dimensions, characteristics, and ranges of dimensions and characteristics are provided in the following description and associated with the example golf club head structures shown in FIGS. 1A through 1C. Those skilled in the art will understand, however, that the drawings, dimensions, characteristics, and ranges of dimensions and characteristics described below simply represent examples of golf club and golf club head structures and characteristics that may be used or exhibited in accordance with at least some examples of this invention. The actual dimensions and/or characteristics of a club head may vary substantially and still fall within the scope of the present invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Clubs and Golf Club Heads According to Examples of the Invention In general, as described above, aspects of this invention relate to golf club heads, golf clubs, and the like. One aspect of golf clubs and golf club heads in accordance with at least some examples of this invention relates to the club head design. In at least some example structures according to the invention, the golf club heads may be designed so as to move the club head's center of gravity rearward and/or low in the overall club head structure (e.g., optionally, as far away from the club head face member and/or as close to the club head sole member as reasonably possible), in order to create a golf club structure that is easier to use (e.g., easier to get balls airborne, helps make balls fly farther, straighter, etc.). Conventional club head designs have used weighted members positioned toward the rear of the club head structure in order to move the club head's center of gravity toward the rear. In contrast, aspects of the present invention use the design and/or geometry of the club head, e.g., by "stretching" or enlarging the club head's breadth dimension, to move the club head's center of gravity toward the rear of the club head. By "stretching" or enlarging the club head's breadth dimension in this manner, the center of gravity naturally moves rearward in the club head structure, e.g., rearward relative to a position of the club's hosel or other shaft engagement location. This low and rear located center of gravity promotes better playability as it makes it easier for players to get the ball up into the air during a stroke, it makes it easier to square the club head face at the location of the ball during a stroke, etc.

In at least some examples, club head structures according to the invention will not include separate and/or independent weighted members included within and/or attached to the club head. In still other example club head structures according to the invention, the club head structure will not include specially designed weighted regions to move the center of gravity toward the club head's rear portion.

Golf club heads in accordance with at least some examples of this invention may have a club head body defining an interior chamber, wherein the club head body has an overall club head length dimension of at least 4.5 inches and an overall club head breadth dimension of at least 4.2 inches. The club head further may include structure and/or means for receiving and/or engaging a shaft with the club head body, such as a hosel region or element, an opening in the club head top surface (e.g., in a crown member) for receiving the shaft end, a mechanical connector system, a cylindrical shaft-receiving sleeve (e.g., extending into the interior chamber of the club head), or the like. In at least some examples of the invention, the club head body may have an overall club head length dimension of at least 4.6 inches, a ratio of the overall club head breadth dimension to the overall club head length dimension of at least 0.94 (e.g., even at least 0.95, at least 0.96, at least 0.97, at least 0.98, or higher), and/or a ratio of the overall club head breadth dimension to the overall club head length dimension of 1 or less. Moreover, in at least some examples of this invention, the club head body may be dimensioned such that the overall club head length dimension is 4.7 inches or greater, such that its overall breadth dimension is 4.6 inches or greater, and/or such that its overall size is 470 $cm^3$ or less, or even 460 $cm^3$ or less.

Golf club heads in accordance with still other examples of this invention may use the club head design and/or geometry to produce other desired club head characteristics. For example, in some club head structures in accordance with this invention, the club head will have an increased head and/or face length dimension relative to the club's depth or breadth dimension, which results in a club head that is more torsionally stable (i.e., more resistant to twisting) during a swing, thereby producing a more consistent, reliable, and/or straight golf ball flight. Golf club heads and golf clubs in accordance with at least some of these example aspects of the invention may include a club head body defining an interior chamber, wherein the club head body has an overall club head length dimension of at least 4.6 inches and wherein a ratio of an overall club head breadth dimension to the overall club head length dimension is 1 or less (e.g., even 0.99 or less, 0.98 or less, 0.97 or less, etc., and optionally 0.94 or greater or even 0.95 or greater). The club head further may include structure and/or means for receiving and/or engaging a shaft with the club head body, such as a hosel region or element, an opening in the club head top surface (e.g., in a crown member) for receiving the shaft end, a mechanical connector system, a cylindrical shaft-receiving sleeve (e.g., extending into the interior chamber of the club head), or the like. Such golf club heads may have an overall club head breadth dimension of at least 4.3 inches, at least 4.4 inches, at least 4.5 inches, or even at least 4.6 inches. As with the examples described above, the club head body according to at least some examples of this aspect of the invention may be dimensioned such that the overall club head length dimension is 4.7 inches or greater and/or such that the overall club head body size is 470 $cm^3$ or less, or even 460 $cm^3$ or less.

In accordance with still additional aspects of this invention, golf club heads of the types described above may be included in golf club structures. Such golf club structures may include, for example: (a) a club head including a club head body, wherein the club head body has an overall club head length dimension of at least 4.5 inches and an overall club head breadth dimension of at least 4.2 inches; and (b) a shaft extending from the club head (e.g., the shaft may be made from steel, graphite, or other desired material, including conventional materials known and used in the art). Golf club structures in accordance with other examples of this invention may include: (a) a club head including a club head body, wherein the club head body has an overall club head length dimension of at least 4.6 inches and wherein a ratio of an overall club head breadth dimension to the overall club head length dimension is 1 or less; and (b) a shaft extending from the club head (e.g., as described above, the shaft may be made from steel, graphite, or other desired material). The golf club heads of these example golf club structures, in accordance with at least some examples of these aspects of the invention, may take on one or more of the various additional, more specific characteristics described above, such as the overall length and/or breadth dimension characteristics, the ratios of the overall breadth to length dimensions, the overall club head body size or volume, and/or the like. Golf clubs in accordance with examples of this invention further may include grip elements attached to the shaft, handle members attached to the shaft and/or club head, and/or other features, including conventional features known and included in conventional golf club structures.

Another dimensional feature of a golf club and/or golf club head structure in accordance with at least some examples of this invention relates to the club's "inset" dimension, as shown in FIG. 1A (e.g., the distance, measured parallel with the shaft 106, that the club head body edge lays from the shaft center line). This inset dimension, in accordance with at least some examples of this invention, may be at least 0.4 inches, and even at least 0.5 inches or at least 0.6 inches, in some examples. As for ranges, the inset dimension may be in the range of 0.4 to 1.25 inches in some examples, within the range of 0.4 to 1 inches in some examples, and within the range of 0.5 to 0.75 inches, in other more specific examples.

Specific examples of the invention are described in more detail below. The reader should understand that these specific examples are set forth merely to illustrate examples of the invention, and they should not be construed as limiting the invention.

B. Specific Examples of the Invention

Figure 1B:
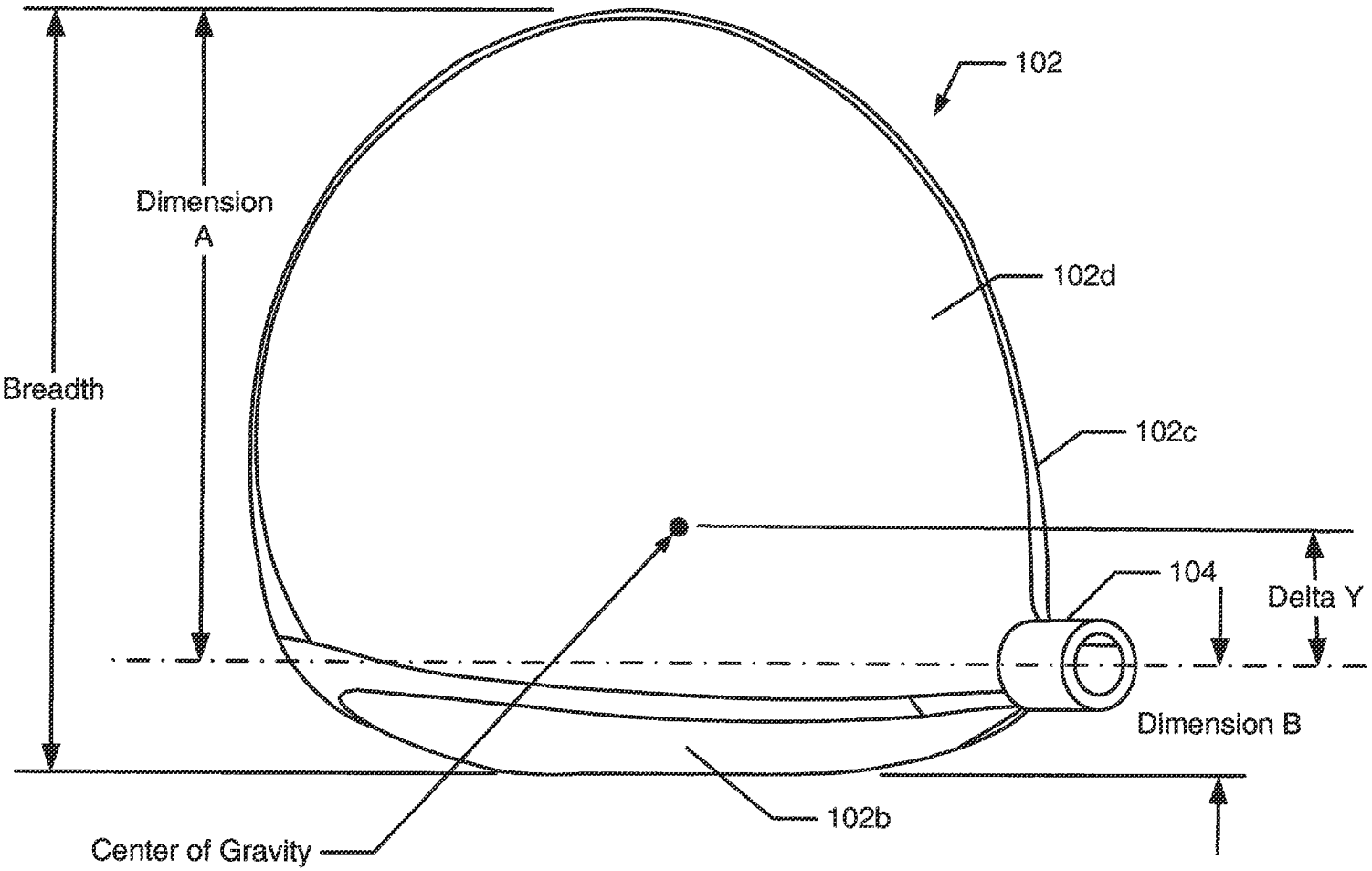
Figure 1C:
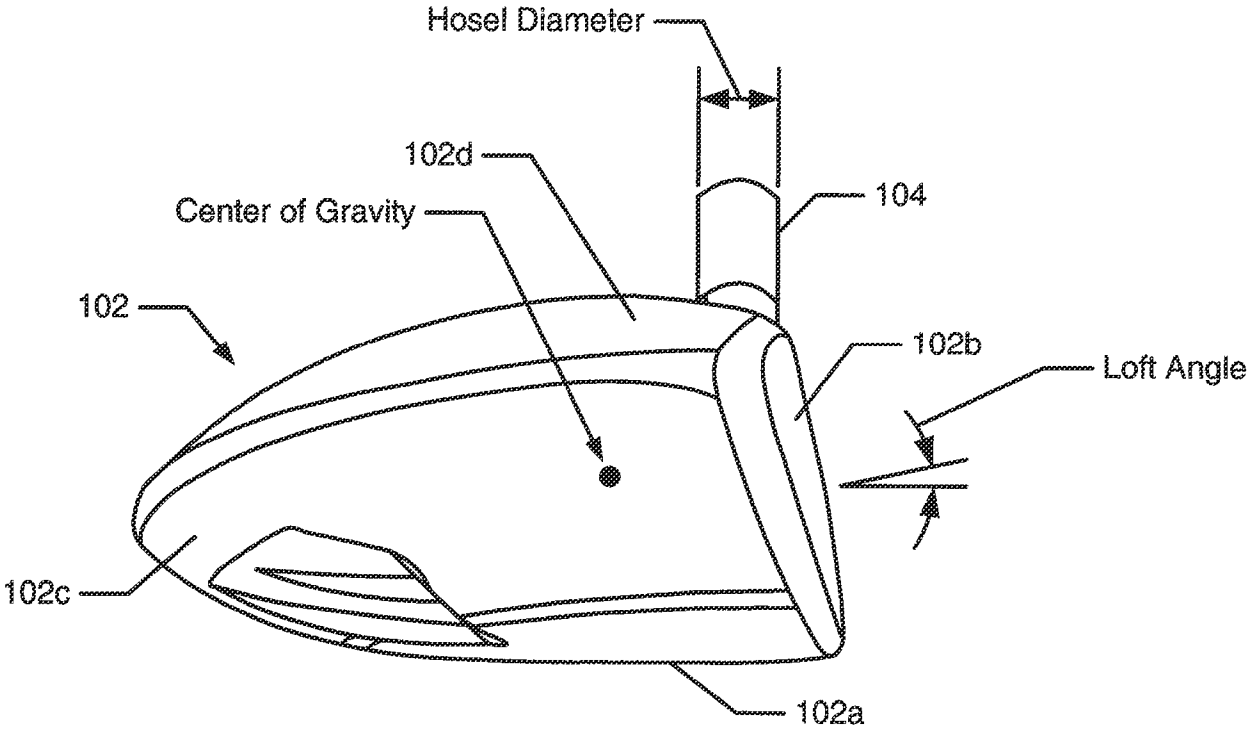

FIGS. 1A through 1C illustrate example golf club and golf club head structures in accordance with the invention. When the same reference number appears in more than one drawing, that reference number is used consistently in this specification and the drawings to refer to the same or similar parts throughout.

Example golf clubs and golf club head structures in accordance with this invention may constitute "wood-type" golf clubs and golf club heads, e.g., club heads typically used for drivers and fairway woods, as well as utility or hybrid type clubs, or the like. Such club head structures may include a multiple piece construction and structure, e.g., including a sole member, a face member, one or more body members (e.g., ribbons of material making up the club head body), and/or a crown member. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention. More specific examples and features of golf club heads and golf club structures according to this invention will be described in detail below in conjunction with the example golf club structures illustrated in FIGS. 1A through 1C.

FIGS. 1A through 1C illustrate an example of a golf club 100, including details of a golf club head structure, in accordance with an example of this invention. Notably, the overall golf club structure 100 of this example includes a golf club head 102, a hosel region 104, a shaft member 106 received in and/or inserted into and/or through the hosel region 104, and a grip or handle member 108 attached to the shaft member 106. Optionally, if desired, the hosel region 104 may be eliminated and the shaft member 106 may be directly inserted into and/or otherwise attached to the head member 102 (e.g., through an opening provided in the top of the club head 102).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 or directly to the club head structure 102, e.g., via adhesives, cements, welding, soldering, mechanical connectors (such as threads, retaining elements, or the like), through a shaft-receiving sleeve or element extending into the club head body 102, etc. The shaft member 106 also may be made from any suitable or desired materials, including conventional materials known and used in the art, such as graphite based materials, composite materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); and/or in any other desired manner. As another example, if desired, the grip or handle member 108 may be integrally formed as a unitary, one-piece construction with the shaft member 106. Additionally, any desired grip or handle member materials may be used without departing from this invention, including rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials known and used in the art. For example, in the example structure shown in FIGS. 1A through 1C, the club head 102 includes a sole member 102*a*, a face member 102*b*, at least one body member 102*c*, and a crown member 102*d*. The body member(s) 102*c* may be formed, for example, as bands or ribbons of material (e.g., optionally U-shaped bands or ribbons) that extend around from one side of the face member 102*b* to the other side and form at least a portion of the perimeter of the middle of the golf club head body 102 (e.g., such that the overall club head structure 102 defines an at least partially hollow interior chamber (e.g., into which the shaft member 106 may be inserted and/or secured)). Any of the individual portions of the club head structure 102 described above may be made from multiple independent pieces, and/or two or more of these individual portions may be integrally formed together, e.g., as unitary, one-piece constructions, without departing from this invention (e.g., the sole and/or crown members additionally may form at least some portions of the club head body and/or face members, etc). As other options, if desired, the overall club head structure 102 may be comprised of a single, one-piece construction or the face member 102*b* may attach to a one piece club head body, etc.

The various individual parts that make up a club head structure 102, if made from multiple pieces, may be engaged and/or held together in any suitable or desired manner, including in conventional manners known and used in the art. For example, the various parts of the club head structure 102 may be joined and/or fixed together (directly or indirectly through intermediate members) by adhesives, cements, welding, soldering, or other bonding techniques; by mechanical connectors (such as threads, screws, nuts, bolts, or other connectors); and the like. If desired, the side edges of various parts of the club head structure 102 (e.g., the edges where sole member 102*a*, face member 102*b*, body members 102*c*, and/or crown member 102*d* contact and join to one another) may include one or more raised ribs, tabs, or other engagement elements that fit into or onto corresponding grooves, slots, surfaces, or openings provided in or on the facing side edge to which it is joined. Cements, adhesives, mechanical connectors, or the like may be used in combination with the raised rib/groove or other connecting structures described above to further help secure the various parts of the club head structure 102 to one another.

In at least some examples of the invention, if desired, the materials making up the various portions of the club head structure 102 may have an increasing density and/or weight as one moves downward from the crown member 102*d* to the sole member 102*a*, e.g., in order to further help move the center of gravity lower in the overall club head structure 102. As examples, if desired, the sole member 102*a* may include or be constructed from at least one member selected from the group of steel materials (including stainless steel materials), titanium alloys, polymeric materials, etc. The various ribbons or body members 102*c* may include or be constructed from at least one member selected from the group of magnesium alloys, titanium alloys, aluminum alloys, polymeric materials, carbon fiber composite materials, glass fiber composite materials, other composite materials, etc. The crown member 102*d*, in at least some examples of the invention, may include or be constructed from at least one member selected from the group of carbon fiber composite materials, glass fiber composite materials, other composite materials, titanium alloy materials, carbon pre-pregs, polymeric materials, etc. The face member 102*b*, in at least some examples of this invention, may include or be constructed from, at least in part, at least one member selected from the group of titanium alloys, steel materials (including stainless steel materials), aluminum alloys, polymeric materials, etc. In some examples, the face member 102*b* may be made, at least in part, from the same material(s) making up the sole member 102*a*. Examples of polymeric materials that may be included in various parts of a club head structure include: thermoplastics (e.g., those suitable for use in injection or blow molding processes, such as thermoplastic polyurethanes, etc.), nylons, polyesters, and the like. If necessary or desired, the polymeric materials further may include metals or metal alloy components, e.g., to affect strength and/or to control weight or density. Of course, materials other than those specifically identified above, including conventional materials known and used in the art, may be used for the various parts of the golf club head structure 102 without departing from this invention.

While, as noted above, the dimensions and/or other characteristics of a golf club head structure according to examples of the invention may vary significantly without departing from the invention, various example dimensions and characteristics of an example club head structure 102 are identified in FIGS. 1A through 1C. Example ranges for the dimensions and/or characteristics for a club head structure 102 in accordance with examples of this invention are set forth in Table 1 below:

TABLE 1

| Dimension or Characteristic | Range (Units) |
|---|---|
| Head Weight | 150 to 240 grams |
| Loft Angle | 7° to 25° |
| Face Angle | 2° Open to 2° Closed |
| Lie Angle | 52° to 68° |
| Center of Gravity Angle | 24° to 40° |
| Inset | 0.4 to 1 inches |
| Head Length | At least 4.5 inches |
| Face Length | At least 3.75 inches |
| Head Height | At least 2 inches |
| Head Breadth | At least 4.2 inches |
| Face Height | At least 1.8 inches |
| Head Length Parallel to Shaft | At least 3.5 inches |
| Face Thickness | 2.4 to 3.5 mm |

TABLE 1-continued

| Dimension or Characteristic | Range (Units) |
|---|---|
| Crown Thickness | 0.5 to 1.2 mm |
| Sole Thickness | 0.5 to 1.2 mm |
| Skirt/Body Member Thickness | 0.5 to 1.2 mm |
| Dimension A (FIG. 1B) | At least 3.5 inches |
| Dimension B (FIG. 1B) | At least 0.4 inches |
| Hosel Diameter | 0.35 to 0.75 inches |
| Volume | At least 380 cc |
| Delta X | 1.1 to 1.6 inches |
| Delta Y | 0.6 to 1.2 inches |
| Delta Z | 2.5 to 4 inches |
| CG-Z | 1 to 1.6 inches |
| EH-Z | 1 to 1.6 inches |
| I(xx) | 260 to 340 kg-mm$^2$ |
| I(yy) | 280 to 360 kg-mm$^2$ |
| I(zz) | 440 to 540 kg-mm$^2$ |
| I(hosel) | 700 to 800 kg-mm$^2$ |
| I(1) | 240 to 320 kg-mm$^2$ |
| I(2) | 300 to 400 kg-mm$^2$ |
| I(3) | 420 to 540 kg-mm$^2$ |
| I(hosel at center of Gravity) | 380 to 480 kg-mm$^2$ |
| Body Density | 3.5 to 5.5 g/cm$^3$ |
| Bulge | 250 to 350 mm |
| Roll | 250 to 350 mm |

Table 1 above describes some general ranges of dimensions that may be used and characteristics that may be exhibited by some specific examples of golf club heads and golf club structures in accordance with this invention. A golf club head need not have dimensions and characteristics that fall within all of the ranges identified in Table 1 to fall within the scope of this invention.

Table 2 below provides additional, more particular ranges of dimensions and characteristics, at least some of which may be exhibited by at least some example golf club heads and golf club structures in accordance with this invention:

TABLE 2

| Dimension or Characteristic | Range (Units) |
|---|---|
| Head Weight | 175 to 225 grams |
| Loft Angle | 7.5° to 13.5° |
| Face Angle | 1° Open to 1° Closed |
| Lie Angle | 55° to 65° |
| Center of Gravity Angle | 28° to 36° |
| Inset | 0.5 to 1 inches |
| Head Length | At least 4.6 inches |
| Face Length | At least 3.8 inches |
| Head Height | At least 2.2 inches |
| Head Breadth | At least 4.3 inches |
| Face Height | At least 2 inches |
| Head Length Parallel to Shaft | At least 3.75 inches |
| Face Thickness | 2.75 to 3 mm |
| Crown Thickness | 0.75 to 1 mm |
| Sole Thickness | 0.75 to 1 mm |
| Skirt/Body Member Thickness | 0.75 to 1 mm |
| Dimension A (FIG. 1B) | At least 3.75 inches |
| Dimension B (FIG. 1B) | At least 0.5 inches |
| Hosel Diameter | 0.45 to 0.75 inches |
| Volume | At least 410 cc |
| Delta X | 1.1 to 1.5 inches |
| Delta Y | 0.75 to 1.2 inches |
| Delta Z | 2.75 to 3.5 inches |
| CG-Z | 1.1 to 1.5 inches |
| EH-Z | 1.1 to 1.5 inches |
| I(xx) | 280 to 320 kg-mm$^2$ |
| I(yy) | 300 to 340 kg-mm$^2$ |
| I(zz) | 460 to 520 kg-mm$^2$ |
| I(hosel) | 720 to 780 kg-mm$^2$ |
| I(1) | 250 to 310 kg-mm$^2$ |
| I(2) | 320 to 380 kg-mm$^2$ |
| I(3) | 440 to 520 kg-mm$^2$ |
| I(hosel at center of Gravity) | 400 to 460 kg-mm$^2$ |
| Body Density | 3.75 to 5.25 g/cm$^3$ |

TABLE 2-continued

| Dimension or Characteristic | Range (Units) |
|---|---|
| Bulge | 260 to 340 mm |
| Roll | 260 to 340 mm |

The various ranges provided in Table 2 are simply examples. A golf club head structure need not have dimensions or characteristics that satisfy all of these identified ranges to fall within the scope of this invention.

Table 3 provides even more targeted dimensions and characteristics of an example golf club head and/or golf club structure in accordance with a specific example of this invention. Of course, a golf club head need not have these specific dimensions and/or characteristics to fall within the scope of this invention.

TABLE 3

| Dimension or Characteristic | Range (Units) |
|---|---|
| Head Weight | 197.4 grams |
| Loft Angle | 10.5° |
| Face Angle | 0.5° Open |
| Lie Angle | 60.5° |
| Center of Gravity Angle | Approx. 30° |
| Inset | 0.6 inches |
| Head Length | 4.71 inches |
| Face Length | 4.13 inches |
| Head Height | 2.34 inches |
| Head Breadth | 4.66 inches |
| Face Height | 2.12 inches |
| Head Length Parallel to Shaft | 3.99 inches |
| Face Thickness | 2.8 mm |
| Crown Thickness | 0.85 mm |
| Sole Thickness | 0.85 mm |
| Skirt/Body Member Thickness | 0.85 mm |
| Dimension A (FIG. 1 B) | 3.95 inches |
| Dimension B (FIG. 1 B) | 0.7 inches |
| Hosel Diameter | 0.52 inches |
| Volume | 458.2 cc |
| Delta X | Approx. 1.3 inches |
| Delta Y | Approx. 0.8 inches |
| Delta Z | 3.32 inches |
| CG-Z | Approx. 1.2 inches |
| EH-Z | Approx. 1.2 inches |
| I(xx) | 286.7 kg-mm$^2$ |
| I(yy) | 317.8 kg-mm$^2$ |
| I(zz) | 464 kg-mm$^2$ |
| I(hosel) | 754 kg-mm$^2$ |
| I(1) | 269.1 kg-mm$^2$ |
| I(2) | 333.9 kg-mm$^2$ |
| I(3) | 465.6 kg-mm$^2$ |
| I(hosel at center of Gravity) | 433 kg-mm$^2$ |
| Body Density | 4.5 g/cm$^3$ |
| Bulge | 305 mm |
| Roll | 305 mm |

While specific dimensions, characteristics, and/or ranges of dimensions and characteristics are set forth in the various tables above, those skilled in the art will recognize that these dimensions and ranges are examples that may be used in at least some examples of the invention. Many variations in the ranges and the specific dimensions and characteristics may be used without departing from this invention, e.g., depending on the type of club, user preferences, user swing characteristics, and the like. For example, the information contained in Table 3 relates to a golf club head generally characterized as a driver. Other dimensions may be used without departing from the invention, such as other loft angles, head weights, lie angles, etc., e.g., if the club is designed as a 3-wood, 5-wood, etc.; to suit a user's preferences and/or swing characteristics; to provide the desired launch angle, carry distance, and/or other characteristics for the club; etc. Additionally, various different shaft characteristics (such as stiffness, flex point, kick point, etc.) may be used to further allow change and control over the club's and the club head's feel and characteristics.

As noted above, golf club heads in accordance with still other examples of this invention also may use the club head design and/or geometry to produce other desired club head characteristics. For example, in some club head structures in accordance with this invention, the club head will have an increased head and/or face length (e.g., heel to toe) relative to the club head's depth or breadth (e.g., front to back), which results in a club head that is more torsionally stable (i.e., more resistant to twisting), thereby producing a more consistent, reliable, and/or straight golf ball flight. Golf club heads and golf clubs in accordance with at least some of these example aspects of the invention may include a club head body having an overall club head length dimension of at least 4.6 inches and a ratio of an overall club head breadth dimension to the overall club head length dimension of 1 or less. In such golf club heads, the overall club head breadth dimension may be at least 4.3 inches, at least 4.4 inches, at least 4.5 inches, or even at least 4.6 inches. As with the examples described above, the club head body according to at least some examples of this aspect of the invention may be dimensioned such that the overall club head length dimension is 4.7 inches or greater and/or such that the overall club head body size is 470 cm$^3$ or less, or even 460 cm$^3$ or less.

Figure 2:
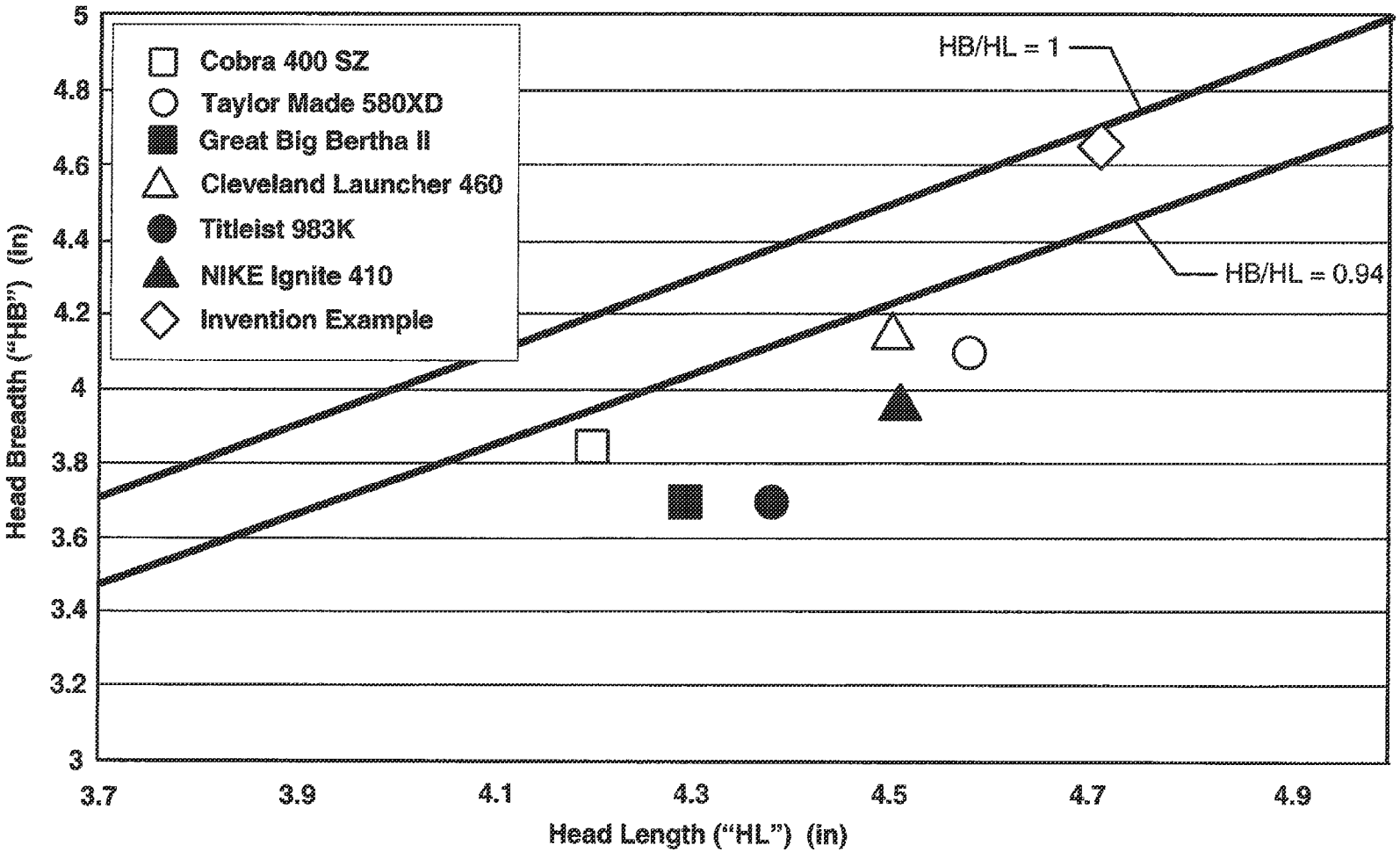
FIG. 2 provides a graph illustrating golf club head length and breadth dimensions for example golf club heads according to the invention as compared with various commercially available golf club head structures.

FIG. 2 provides a chart graphically comparing the overall head length dimension and the overall head breadth dimension of an example golf club head in accordance with at least some examples of the invention with other commercially available golf club head structures. As shown in FIG. 2, the golf club head structure according to the illustrated example of the invention (e.g., the structure shown in FIGS. 1A through 1C) has a greater head length dimension and a greater head breadth dimension than the various commercially available club head structures shown in the figure. The upper diagonal line in the graph represents a line at which a ratio of the club head breadth dimension to the club head length dimension is equal to 1 (the current Rules of Golf require golf club heads to have a heel to toe length of 5 inches or less, and the club head length must be greater than the club head breadth (i.e., the face to back dimension)). The lower diagonal line represents a line at which the ratio of the club head breadth dimension to the club head length dimension is equal to 0.94. Club heads in accordance with at least some examples of this invention may have a ratio of club head breadth to club head length of at least 0.94, at least 0.95, at least 0.96, at least 0.97, or even at least 0.98.

Of course, many modifications to the overall club head structures and/or the overall golf club structures may be made without departing from this invention. For example, many modifications may be made to the part or parts making up the club head structure, to the materials used in making the club head structure, to the manner in which the club head structure is joined together, etc. Also, many modifications may be made to the thickness, weight, shape, and/or other physical characteristics of the part or parts making up the overall golf club structure, to the manner in which these parts are fixed together, to the materials used in these parts, etc.

Also, as noted above, aspects of the present invention may be used for any type of golf club structures and/or golf club head structures, including, for example: "wood-type" golf clubs and golf club heads, such as drivers or fairway woods, utility or hybrid type clubs, and/or the like.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head, comprising:

a club head body having an overall club head length dimension of at least 4.7 inches and an overall club head breadth dimension of at least 4.6 inches, wherein a ratio of the overall club head breadth dimension to the overall club head length dimension is at least 0.98 and is less than 1, wherein the club head body further has a center of gravity, a hosel center axis, and a Delta Y dimension within a range of 0.6 to 1.2 inches, wherein the Delta Y dimension is a rearward distance between the hosel center axis and the center of gravity.

2. A golf club head according to claim 1, wherein the golf club head has a moment of inertia about the z-axis, Izz, in a range from 460 kg-mm$^2$ to 520 kg -mm$^2$.

3. A golf club head according to claim 1, wherein the club head body has a rearmost location and a Dimension A of at least 3.5 inches, wherein Dimension A is a rearward distance between the hosel center axis and the rearmost location.

4. A golf club head according to claim 1, wherein the golf club head has a moment of inertia about the z-axis, Izz, in a range from 460 kg-mm$^2$ to 470 kg -mm$^2$.

5. A golf club head according to claim 1, wherein the club head body has a rearmost location and a Dimension A of at least 3.75 inches, wherein Dimension A is a rearward distance between the hosel center axis and the rearmost location.

6. A golf club head according to claim 1, wherein the golf club head has a moment of inertia about the y-axis, Iyy, in a range from 300 kg-mm$^2$ to 340 kg -mm$^2$.

7. A golf club head according to claim 1, wherein the golf club head has a moment of inertia about the x-axis, Ixx, in a range from 280 kg-mm$^2$ to 320 kg -mm$^2$.

8. A golf club head according to claim 1, wherein the Delta Y dimension is within a range of 0.75 to 1.2 inches.

9. A golf club head according to claim 1, wherein the club head body has a volume of approximately 470 cm$^3$ or less.

10. A golf club head according to claim 1, wherein the club head body includes a sole member, a crown member, and a face member connected with the sole member and crown member.

11. A golf club head according to claim 10, further comprising a ribbon member located between the crown member and the sole member.

12. A golf club head according to claim 10, wherein the sole member has a higher density than a density of the crown member.

13. A golf club head according to claim 1, wherein a crown portion of the club head body includes a carbon fiber composite material.

14. A golf club head according to claim 1, wherein a crown portion of the club head has a thickness of approximately 0.85 mm.

15. A golf club head according to claim 1, wherein the golf club head body has a density that increases from a crown portion to a sole portion.

16. A golf club head according to claim 1, wherein the golf club head has a crown member constructed from carbon fiber and a sole member constructed from one of a steel material, a titanium alloy and a polymeric material.

17. A golf club according to claim 1, further comprising a means for engaging a shaft with the club head body.

18. A golf club head according to claim 1, wherein the club head body includes a hosel member for receiving a shaft.

19. A golf club head according to claim 1, wherein the club head body has an inset dimension of at least 0.5 inches.

20. A golf club head according to claim 1, wherein the club head body has an inset dimension of at least 0.6 inches.

21. A wood-type golf club head, comprising:

a face member; and a club head body engaged with the face member, wherein the club head body includes a hosel region for receiving a shaft extending outward at a top, front, heel area of the club head body, wherein the club head body is made from a multiple piece construction, and wherein at least a crown portion of the club head body is constructed from a titanium alloy, wherein the club head body has an overall club head length dimension of at least 4.7 inches and an overall club head breadth dimension of at least 4.6 inches, wherein a ratio of the overall club head breadth dimension to the overall club head length dimension is at least 0.99 and is less than 1, wherein the club head body has a volume of at least 410 cubic centimeters and less than 470 cubic centimeters, wherein the club head body has a mass in a range of 175 to 225 grams, and wherein the golf club head has a moment of inertia about the z-axis, Izz, in a range from 440 to 540 kg-mm$^2$.

22. A wood-type golf club head according to claim 21, wherein the golf club head has a moment of inertia about the z-axis, Izz, in a range from 460 kg-mm$^2$ to 520 kg-mm$^2$.

23. A wood-type golf club head according to claim 21, wherein the golf club head has a moment of inertia about the y-axis, Iyy, in a range from 300 kg-mm$^2$ to 340 kg-mm$^2$.

24. A wood-type golf club head according to claim 21, wherein the golf club head has a moment of inertia about the x-axis, Ixx, in a range from 280 kg-mm$^2$ to 320 kg-mm$^2$.

25. A wood-type golf club head according to claim 21, wherein the club head body includes a sole member, a crown member, and a face member connected with the sole member and crown member.

26. A wood-type golf club head according to claim 25, further comprising a ribbon member located between the crown member and the sole member.

27. A wood-type golf club head according to claim 25, wherein the sole member has a higher density than a density of the crown member.

28. A wood-type golf club head according to claim 25, wherein the club head body has an inset dimension of at least 0.5 inches.

29. A wood-type golf club head according to claim 25, wherein the club head body has an inset dimension of at least 0.6 inches.

30. A wood-type golf club head, comprising:

a face member; and a club head body engaged with the face member, wherein the club head body includes a hosel region for receiving a shaft extending outward at a top, front, heel area of the club head body, wherein the club head body is made from a multiple piece construction, and wherein at least a crown portion of the club head body is constructed from a titanium alloy, wherein the club head body has an overall club head length dimension of at least 4.7 inches and an overall club head breadth dimension of at least 4.6 inches, wherein a ratio of the overall club head breadth dimension to the overall club head length dimension is at least 0.94 and is less than 1, wherein the club head body has a volume of at least 410 cubic centimeters and less than 470 cubic centimeters, wherein the club head body has a mass in a range of 175 to 225 grams, and wherein the golf club head has a moment of inertia about the z-axis, Izz, in a range from 440 to 540 kg-mm$^2$.

31. A wood-type golf club head according to claim 30, wherein the club head body has a rearmost location, a hosel center axis, and a Dimension A of at least 3.5 inches, wherein Dimension A is a rearward distance between the hosel center axis and the rearmost location.

32. A wood-type golf club head according to claim 30, wherein the club head body has a rearmost location, a hosel center axis, and a Dimension A of at least 3.75 inches, wherein Dimension A is a rearward distance between the hosel center axis and the rearmost location.

33. A wood-type golf club head according to claim 30, wherein the club head body has a center of gravity, a hosel center axis, and a Delta Y dimension within a range of 0.6 to 1.2 inches, wherein the Delta Y dimension is a rearward distance between the hosel center axis and the center of gravity.

34. A wood-type golf club head according to claim 30, wherein the club head body has a center of gravity, a hosel center axis, and a Delta Y dimension within a range of 0.75 to 1.2 inches, wherein the Delta Y dimension is a rearward distance between the hosel center axis and the center of gravity.

35. A wood-type golf club head according to claim 30, wherein the club head body has an inset dimension of at least 0.5 inches.

* * * * *